US005850789A

United States Patent [19]

Rudolf et al.

[11] Patent Number: 5,850,789

[45] Date of Patent: Dec. 22, 1998

[54] METHOD AND APPARATUS FOR MOUNTING PRINTING PLATES

[75] Inventors: Andreas Johannes Rudolf, Goslar, Germany; David Leo Fox, North Rose, N.Y.; John Leon Fox, Rose, N.Y.; Richard Orton Toles, Wolcott, N.Y.; David Anthony Debski, Newark, Del.; William Webb Early, Wilmington, Del.; Christian Beers, Roedermark, Germany

[73] Assignee: E. I. du Pont de Nemours and Company, Wilmington, Del.

[21] Appl. No.: 898,098

[22] Filed: Jul. 22, 1997

[51] Int. Cl.[6] ..... B41L 3/08

[52] U.S. Cl. ..... 101/486; 101/DIG. 36; 33/621

[58] Field of Search ..... 101/481, 485, 101/486, DIG. 36, 401.1; 33/620, 621, 614, 617; 364/470.06

[56] References Cited

U.S. PATENT DOCUMENTS

| | | | |
|---|---|---|---|
| 4,380,956 | 4/1983 | Elworthy | 101/401.1 |
| 4,383,760 | 5/1983 | Deter et al. | 101/DIG. 36 |
| 4,520,389 | 5/1985 | Hornschuh | 33/617 |
| 4,872,407 | 10/1989 | Banke | 101/389.1 |
| 5,031,334 | 7/1991 | Takamura | 33/621 |
| 5,058,287 | 10/1991 | Harley | 33/618 |
| 5,117,365 | 5/1992 | Jeschke et al. | 101/481 |
| 5,132,911 | 7/1992 | Leader, Jr. et al. | 33/621 |
| 5,136,948 | 8/1992 | Fujino et al. | 101/486 |
| 5,317,971 | 6/1994 | Deye, Jr. et al. | 101/486 |
| 5,377,590 | 1/1995 | Bolza-Schünemann et al. | 101/389.1 |
| 5,439,328 | 8/1995 | Haggerty et al. | 408/1 R |
| 5,459,941 | 10/1995 | Lowe | 33/620 |
| 5,551,339 | 9/1996 | Schädlich et al. | 101/DIG. 36 |
| 5,752,446 | 5/1998 | Squibb | 101/486 |

FOREIGN PATENT DOCUMENTS 0 728 580 A1 6/1996 European Pat. Off. .

*Primary Examiner*—Eugene H. Eickholt
*Attorney, Agent, or Firm*—Thomas H. Magee

[57] ABSTRACT

An apparatus and method for mounting a plurality of plates onto a carrier sheet includes a table mounted on a stationary base, each plate having a first and a second registration mark thereon. A first camera assembly is moveably attached to a support adjacent the table and is connected to a first video monitor for viewing the first registration marks. A second video camera is moveably attached to the support adjacent the table and is connected to a second video monitor for viewing the second registration marks. Linear actuators are connected to the first and the second camera assemblies and to the table for independently moving each camera assembly relative to the table. A motion controller is connected to the linear actuators for sending moving signals thereto, and generates at least two moving signals corresponding to the two registration marks for each plate. Each plate is positioned on the carrier sheet beneath the first and the second camera assemblies so that the first registration mark aligns with a cross-hair image on the first video monitor and the second registration mark aligns with a cross-hair image on the second video monitor.

16 Claims, 2 Drawing Sheets

METHOD AND APPARATUS FOR MOUNTING PRINTING PLATES

BACKGROUND OF THE INVENTION

1. Field of the Invention

This invention pertains to a method and apparatus for mounting plates onto a carrier sheet, and particularly for registration mounting flexographic printing plates onto the carrier sheet.

2. Description of Related Art

Flexographic printing plates are resilient relief image plates made of rubber or photopolymer or similar materials which are used to print on a wide variety of substrates. One critical step in the printing process is the accurate positioning of the printing plates onto the printing cylinder. The printing plate must be positioned such that the printing is parallel to the axis of the cylinder, i.e., not skewed. In multicolor printing, the plates for each different color must be aligned so they print in register. Frequently, this positioning is accomplished using pin registration drilling and mounting devices. The printing plate cylinder is typically removed from the printing press, and the plates are mounted to the cylinder using registration holes often in combination with a separate mounting device. However, for some printing presses, such as those typically used to print corrugated containers, the printing cylinders generally are not removed from the press.

A conventional method for mounting flexographic plates for corrugated printing involves the use of a carrier sheet and a mounter/proofer unit. One or more plates are mounted onto a large flexible sheet known as the carrier sheet, and attached with adhesive or stickyback tape. Oftentimes in corrugated printing of cardboard boxes for example, relatively small areas on each side of a box are printed which require the mounting of several plates onto the carrier sheet. The plates are placed on the carrier sheet by manually measuring plate locations and then manually positioning the plates on the carrier sheet using optical guides and mirrors. The carrier sheet is then placed on the printing cylinder of the press. For printing in the corrugated post print market, one color or multiple color jobs have to be positioned. For multicolor printing, the plates for each successive color are positioned onto their carrier sheets using a mounter/proofer unit with mirror. This practice is time intensive, highly dependent on the operator's skills, and potentially fraught with errors and inconsistent results. As the demands for improved registration increase, this method becomes increasingly unsatisfactory.

A major advance in the method of mounting plates for corrugated printing was achieved by the introduction of a single-head drill. With this drill, the printer was able to drill registration holes in both the carrier sheet and the plates. The plates were then mounted on the carrier sheet using mounting pins and stickyback tape. Once the plates were mounted, the pins were removed. Thus the alignment of the plates on the carrier sheet was the same for each color and the need to use the mounter/proofer was eliminated. Both the speed and the accuracy of the mounting process were improved.

However, drilling of the carrier sheet and the plates independently takes time and still does not resolve the potential for placement and other errors since the location of the plates can be miscalculated and placed at the wrong location on the carrier sheet.

Further, corrugated printers after a print run, often retain the carrier sheet with the mounted plates of each color for subsequent printing runs. However, problems arise when one or more plates may lift from the carrier sheet during storage as it is very difficult to replace the plate in registration with the others. It is also possible that an additional color may have to be added during subsequent printing and heretofore it was very difficult to mount the plates on the carrier sheet for the new color in exact position to assure registration with the previously mounted plates on the carrier sheets for the other colors.

SUMMARY OF THE INVENTION

It is an object of this invention to provide a method and apparatus for mounting one or more plates onto a carrier sheet without drilling and the use of mounting pins.

It is another object of this invention to provide a method and apparatus for mounting one or more plates onto a carrier sheet which eliminates the need for manual calculations and manual placement and instead automatically determines the correct location of the plates on the carrier sheet.

It is another object of this invention to provide a method and apparatus for mounting one or more plates onto a carrier sheet which assures initial and continued registration with the plates mounted on other carrier sheets for multiple color printing.

In accordance with this invention there is provided an apparatus and method for mounting a plurality of plates onto a carrier sheet, each plate having a first and a second registration mark thereon. The apparatus includes a table mounted on a stationary base. A first camera assembly is moveably attached to a support adjacent the table and is connected to a first video monitor for viewing the first registration marks. A second video camera is moveably attached to the support adjacent the table and is connected to a second video monitor for viewing the second registration marks. Linear actuators are connected to the first and the second camera assemblies and to the table for independently moving each camera assembly relative to the table. A motion controller is connected to the linear actuators for generating at least two moving signals corresponding to the two registration marks for each plate. Each plate is positioned on the carrier sheet beneath the first and the second camera assemblies so that the first registration mark aligns with a cross-hair image on the first video monitor and the second registration mark aligns with a cross-hair image on the second video monitor.

In accordance with another aspect of this invention, the first and second camera assemblies are adapted to move along the support in a first direction, and the second camera assembly includes an offset adjustment assembly comprising a moveable stage adapted to move along a second direction orthogonal to the first direction.

DESCRIPTION OF THE PREFERRED EMBODIMENT(S)

Figure 1:
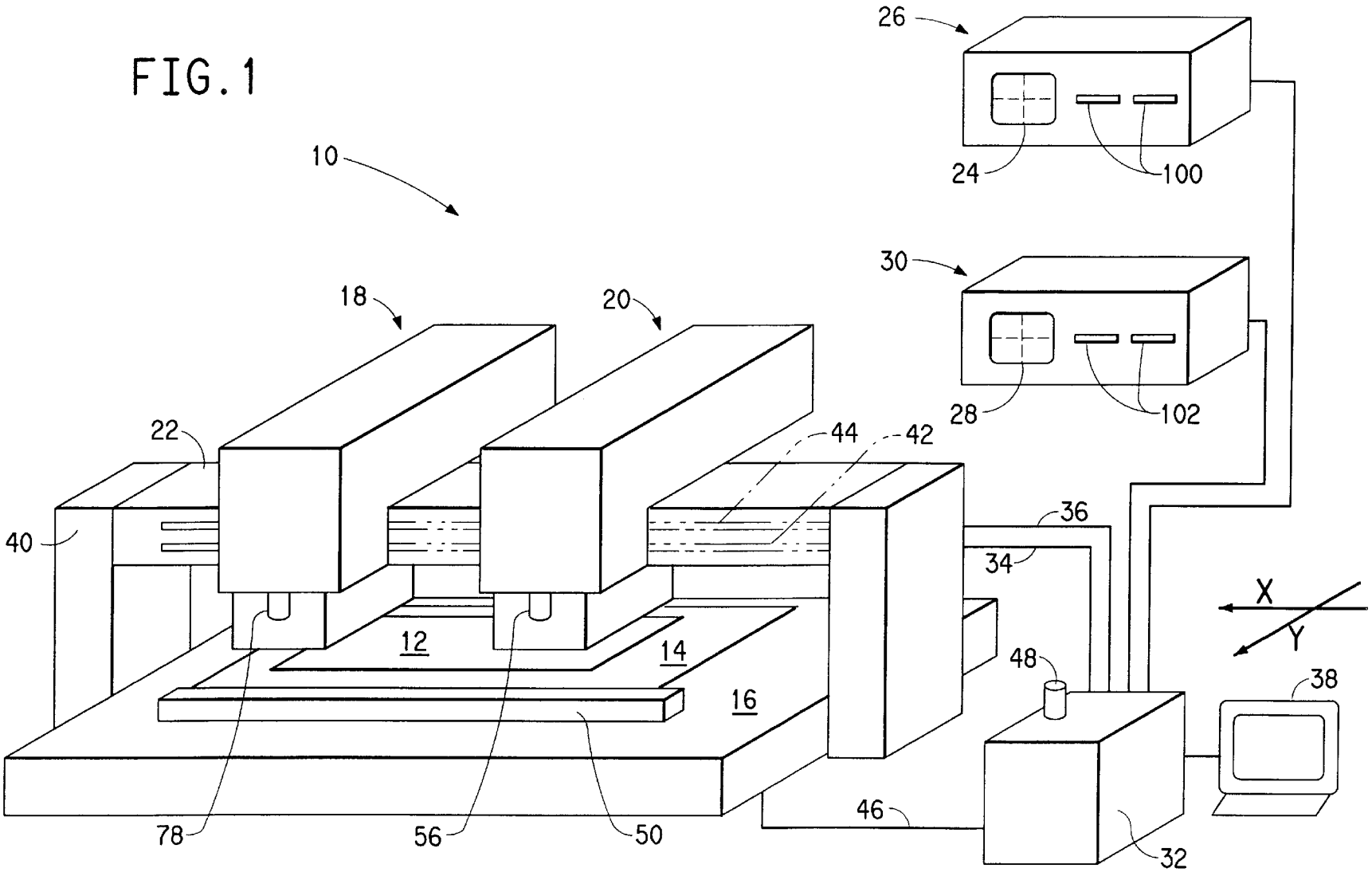
FIG. 1 is a perspective diagrammatic view of an apparatus for mounting plates onto a carrier sheet showing a right camera assembly and a left camera assembly.

FIG. 1 illustrates an apparatus 10 for mounting a plurality of printing plates 12, e.g., flexographic printing plates, onto a carrier sheet 14, each plate 12 having a first and a second registration mark thereon. The apparatus 10 comprises a moveable table 16 on top of which the carrier sheet 14 is mounted, a first camera assembly 18 adjacent to table 16 and moveably attached to a guide supporting member 22, and a second camera assembly 20 adjacent the table 16 and moveably attached to the guide supporting member 22. The first camera assembly 18 is connected to a first TV-monitor 24 in a first display unit 26 for viewing the first registration marks, and the second camera assembly 20 is connected to a second TV-monitor 28 in a second display unit 30 for viewing the second registration marks. In the preferred embodiment, the first and second TV-monitors 24 and 26 are connected, respectively, to the first and second camera assemblies 18 and 20 via a motion controller 32. The apparatus 10 further includes means connected to the first and the second camera assemblies 18 and 20 for independently moving each assembly 18 and 20 relative to the table 16. The motion controller 32 is also connected to the moving means for sending moving signals thereto, the motion controller 32 generating at least two moving signals over lines 34 and 36 corresponding to the two registration marks for each plate 12. The moving signals generated by the motion controller 32 are controlled either from a preprogrammed memory card in the motion controller 32 or from a software program run by a computer 38 connected thereto.

The moveable table 16 is slideably mounted over a stationary base (not shown) using guide blocks having ball raceways over a pair of grooved rails (not shown), which are located on top of the stationary base to provide movement of the table 16 in a direction perpendicular to the guide supporting member 22, hereinafter called the y-direction. The guide supporting member 22 is secured at its ends to the stationary base by end supports 40 and at a level above the table 16 and parallel thereto. The guide supporting member 22 includes a first threaded shaft 42 journaled within a threaded guide bracket attached to the first camera assembly 18 so that the first camera assembly 18 is caused to move over the table 16 parallel to the guide supporting member 22 when the first threaded shaft 40 is rotated. This direction of movement parallel to the guide supporting member 22 is hereinafter called the x-direction. A second threaded shaft 44 is connected similarly to the second camera assembly 20. Both the first and the second shafts 42 and 44 are rotated by DC servo motors (not shown) located within the end supports 40 which are connected to and controlled by the moving signals received over lines 34 and 36 from the motion controller 32. A third threaded shaft (not shown) provides movement of the table 16 in the y-direction, this movement being independent of movement of the first and second camera assemblies 18 and 20 in the x-direction. The third shaft is rotated by a DC servo motor which also is connected to and controlled by a moving signal received over line 46 from the motion controller 32. If desired, the moving signals can be generated manually by use of a joystick 48 instead of preprogrammed coordinates as described below. The table 16 is adapted along its front x-direction edge to accurately locate a positioning bar 50, also extending in the x-direction.

Figure 2:
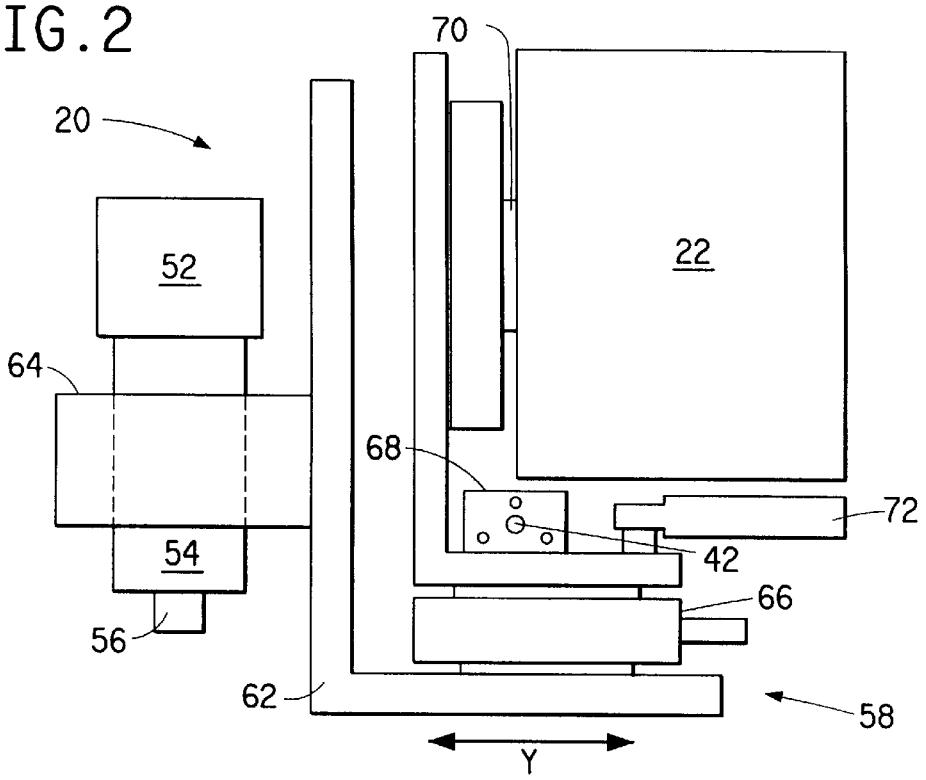
FIG. 2 is a schematic elevation view of the right camera assembly of the apparatus of FIG. 1, showing a camera and an offset adjustment assembly.

FIG. 2 illustrates the second camera assembly 20 previously described as mounted and moveable in the x-direction over the table 16 which is moveable in the y-direction. The second camera assembly 20 includes a camera 52, a camera lens 54, a window 56 and an offset adjustment assembly 58. The second camera assembly 20 also includes a preregistration light assembly (not shown) which is the same as the preregistration light assembly 80 described below in detail in association with the first camera assembly 18. The camera 52 and lens 54 are mounted to a camera mounting bracket 62 on the offset adjustment assembly 58 with a clamp 64 so that the camera 52 and lens 54 are directed toward the table 16. The window 56 is attached to the lens 54 to prevent dust from contaminating the lens 54. When the first and second camera assemblies 18 and 20 and the table 16 are in position to correspoond to the x- and y-coordinates for a particular registration mark, the lens 54 of the camera 52 is focused upon the carrier sheet 14 (or the registration mark of the particular plate).

The offset adjustment assembly 58 includes a moveable stage 66 for the camera mounting bracket 62 having the camera 52 and lens 54 mounted thereto. The stage 66 is mounted to a linear actuator 68 including the threaded guide bracket attached to the first threaded shaft 42 of the guide supporting member 22, which cooperatively function as means for moving the threaded guide bracket along a linear bearing 70 in the x-direction. The moveable stage 66 has a rotary encoder and a motor (not shown) which permits motion of the camera 52 in the y-direction.

The offset adjustment assembly 58 is particularly useful when one or more plates 12 are remounted to the carrier sheet 14 or one or more additional plates 12 are mounted to the carrier sheet 14 subsequent to the original mounting operation. It is very difficult to remount single plates from "old" carrier sheets which have been in use for some time at the customer. Most of these "old" carrier sheets have been mounted without the help of electronic systems and therefore not all of these old mounts are real parallel. The offset function of one camera permits the mounting of new plates in exactly the same position as the old plates even though such plates were not 100% in parallel. The offset adjustment assembly 58 permits the operator to adjust the coordinate of the camera 52 in the second camera assembly 20 in the y-direction to properly register the remounted or new plate. The offset adjustment assembly 58 retains the adjustment offset for subsequent mounting of the corresponding plates on the other carrier sheets and therefore does not need to be reset or reestablished for each subsequent mounting of a plate.

The first camera assembly 18 is similar to the above-described second camera assembly 20 without the offset adjustment assembly 58, so that the camera mounting bracket 60 is attached directly to the threaded guide bracket connected to the second threaded shaft 44. As shown in FIG. 2, each camera assembly 18 and 20 also has a linear encoder 72, e.g., Anilam linear scales, connected to the motion controller 32 for measuring the precise position of each camera assembly 18 and 20 along the x-axis. The moveable table 16 includes a rotary encoder (not shown) connected to the motion controller 32 for measuring the precise position of the table 16 along the y-axis. The positions of each camera assembly 18 and 20 along both axes are transmitted from the motion controller 32 and displayed, respectively, on the first and second display units 26 and 30 which show numerical values for the x- and y-position coordinates of the camera assemblies 18 and 20 relative to the moveable table 16. The motion controller 32 retains the coordinate positions of the table 16 and the camera assemblies 18 and 20 so that if the table 16 is moved during the mounting operation, the table 16 will automatically return back to the desired y-coordinate position.

Figure 3:
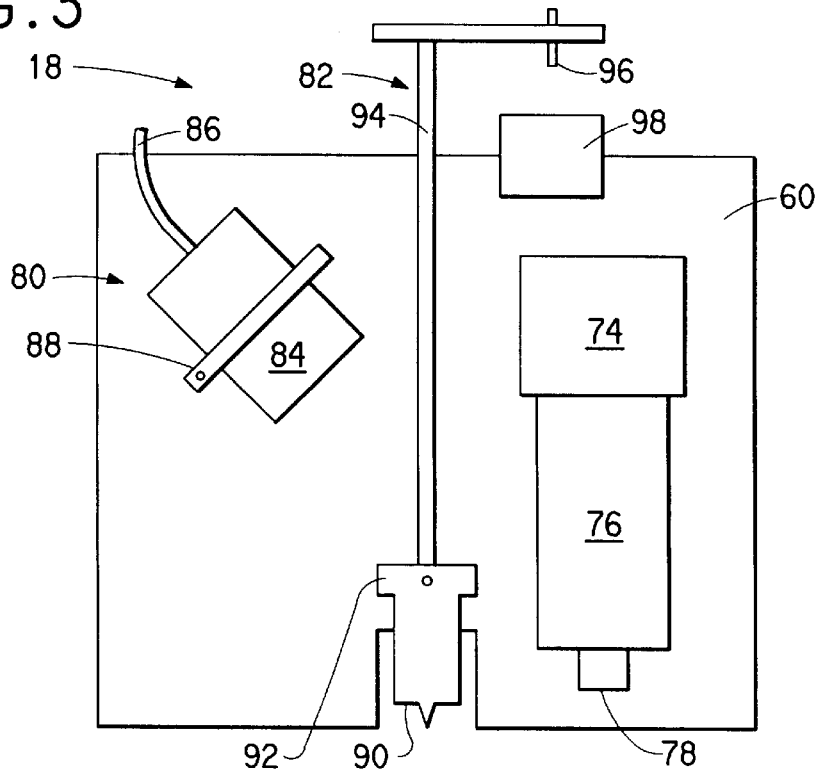
FIG. 3 is a schematic elevation view of the left camera assembly of the apparatus of FIG. 1, showing a camera, a light assembly, and a plotting pen assembly.

FIG. 3 illustrates the first camera assembly 18 previously described as mounted and moveable in the x-direction over the table 16 which is moveable in the y-direction. The first camera assembly 18 includes a camera 74, a camera lens 76, a window 78, a preregistration light assembly 80, and a plotting pen assembly 82. The camera 74, lens 76, and window 78 are the same as described above for the second camera assembly 20 with the exception that the camera 74 and lens 76 are not mounted to an offset adjustment assembly 58 but are mounted to a camera mounting bracket 60 attached directly to the threaded guide bracket connected to the second threaded shaft 44. The preregistration light assembly 80 includes a light focusing lens 84 attached to a flexible fiber optic cable 86. The fiber optic cable 86 is attached to a light source (not shown), such as a quartz halogen optic illuminator, located on the guide supporting member 22. The light focusing lens 84 is held in place by a clamp 88 to the camera mounting bracket 60, and is positioned to shine light on the area on the carrier sheet 14 directly beneath the lens 76 and camera 74. The preregistration light assembly 80 illuminates the area on the carrier sheet 14 as well as the registration mark on the plate 12 at the location of the x- and y-coordinates for the particular registration mark. The first camera assembly 18 also includes a preregistration light assembly 80 as described but not shown.

The first camera assembly 18 includes an opening 90 for positioning a pen 92 of the plotting pen assembly 82. The plotting pen assembly 82 includes the plotting pen 92 attached to a moveable rod 94 having a solenoid plunger 96 that is linked to a tubular pull-type solenoid 98. The pen 92 is a conventional pen used for plotting in automatic plotters and can be obtained from Hewlett Packard for example. When not in use, the pen 92 is in a retracted position as shown. In order to use the plotting pen assembly 82 to draw die cut lines or fold lines of the container layout on the carrier sheet 14, the pen 92 is manually pulled down into a ready position at which the solenoid plunger 96 enters the solenoid 98. The solenoid 98 is activated and the pen 92 is moved to contact the carrier sheet 14. The first camera assembly 18 and the table 17 are moved to draw lines on the carrier sheet 14 upon activation by an operator selecting the appropriate file on the computer 38 of the present apparatus.

Each camera assembly 18 and 20 forms, respectively, part of a separate video imaging system including the first and second display units 26 and 30 connected to the cameras 52 and 74. Each display unit 26 and 30 includes, respectively, the TV-monitors 24 and 28 connected to electronic cross-line generators (not shown) which produce on the TV-monitor screens a cross-hair image comprising vertical and horizontal lines. The intersection of the vertical and horizontal lines coincides precisely with the portion of the printing plate 12, i.e., registration mark, positioned directly beneath the center of the camera lens 54 and 76. The TV-cameras 52 and 74 typically produce a 25× magnification of the target area of the printing plate 12. The display units 26 and 30 also comprise numerical or digital displays 100 and 102 which read-out the x- and y-position coordinates of the registration mark. The technology used to generate the cross-hairs, display the received image and read-out the coordinate position of the camera is well known in the art.

In the present invention, the cross-line generators contain a character generator for displaying information on the TV-monitors 24 and 28 in the form of alpha/numeric characters, e.g., A1, A2, . . . B1, B2 . . . , which correspond to the first and second registration marks for each printing plate 12 being mounted on the carrier sheet 14. The character generator receives information from the motion controller 32 and computer 38 as to which plate 12 should be mounted next. The camera assemblies 18 and 20 and respective display units 26 and 30, interconnected by the motion controller 32, provide an optical system enabling accurate positioning of the plates 12 on the carrier sheet 14 supported on the moveable table 16.

A typical process used for the above-described flexographic printing plate mounting apparatus 10 is described below in the context of a corrugated container, e.g., a box. The first step in the process is the preparation of the mechanicals for each color to be printed. The mechanicals are full scale representations of the artwork to be printed, including all registration marks, superimposed on a layout of the unfolded, flat container, i.e., the substrate to be printed. The artwork, including registration marks, and container layout are generated and/or manipulated and then stored electronically in files typically in a pre-press computer. For each printing plate 12 to be mounted on the carrier sheet 14, the artwork specialist determines the position bf the plate relative to a predetermined zero position on the carrier sheet 14 and the position of a first registration mark and a second registration mark for the plate 12 relative to the carrier sheet 14. The position and registration marks for each plate 12 are stored electronically. In addition, die cut lines and fold lines associated with the layout of the container are stored electronically. As understood by those skilled in the art, the electronically stored artwork, including the registration marks, is used to generate a mask which is used to form the relief pattern in the plate 12.

A carrier sheet 14 is placed on the moveable table 16. The carrier sheet 14 is generally a heavy-gage flexible plastic material. A typical carrier sheet 14 is made of polyester and has a thickness in the range of 0.10 mm to 5.0 mm. The carrier sheet 14 is positioned on the table 16 using the positioning bar 50. The bar 50 can be a MATTHEWS® lock or similar positioning device. In some cases, special clamping devices built into the printing cylinder are used to hold the carrier sheet 14 in place during printing. When these are used, it is advantageous to have the same type of clamping device as that used for the bar 50. The carrier sheet 14 can also be positioned using register holes and mounting pins. The pins or bar 50 can be permanently or removably attached to the table 16. The carrier sheet 15 is kept from moving by use of, for example, flat weights or vacuum holddown. The table 16 using vacuum holddown may have several zones in order to accomodate different size carrier sheets.

For each of the plates 12 to be mounted on the carrier sheet 14, a mounter operator retrieves the recorded plate position and registration marks from the pre-press computer which is received in a file on the computer 38 for the mounting apparatus 10. Each of the camera assemblies 18 and 20 is moved independently over the moveable table 16 to a position which is the predetermined zero point. This can be one of the corners of the carrier sheet 14 at the leading edge, the center point of the carrier sheet 14 at the leading edge, etc. The movement of the camera assemblies 18 and 20 relative to the table 16 is accomplished by moving the table 16 along the grooved rails in the y-direction and also moving the camera assemblies 18 and 20 along the guide supporting member 22 in the x-direction. The digital displays 100 and 102 are calibrated to x=0, y=0 at the desired zero point. The table 16 is moved in the y-direction and the camera assemblies 18 and 20 are moved along the guide supporting member 22, in the x-direction until each camera assembly 18 and 20 is at the recorded x- and y-coordinates for the respective registration mark. The first camera assembly 18, in response to a first moving signal from the motion controller 32, is moved along the guide supporting member 22 until at the position having the x- and y-coordinates recorded for the first registration mark for the first plate 12, and the second camera assembly 20, in response to a second signal from the motion controller 32, is moved along the guide supporting member 22 until at the position having the x- and y-coordinates recorded for the second registration mark. The camera assemblies 18 and 20 are locked into place using locking means (not shown). The preregistration light assembly 80 in each camera assembly l8 and 20 illuminates the carrier sheet 14 in the location of the respective registration marks for the first printing plate 12.

Stickyback tape is applied to the non-printing side (non-relief) of the plate 12. It is preferred during mounting that the stickyback tape is covered with an easy-release protective sheet, e.g., waxy paper, and a strip of the stickyback tape central to the plate 12 is not covered to reveal the adhesive. The first printing plate 12 is moved into position above the carrier sheet 14 with the non-relief side toward the carrier sheet 14 and the relief side including first and second registration marks under the preregistration light assembly 80. The plate 12 is then located on the carrier sheet 14, so that the first registration mark in the plate 12 is illuminated by the light assembly 80 of the first camera assembly 18 and aligns with the cross-hair marks shown on the screen of the first TV-monitor 24, and so that the second registration mark in the plate 12 is illuminated by the light assembly 80 of the second camera assembly 20 and aligns with the cross-hair marks shown on the screen of the second TV-monitor 28. The first plate 12 is pressed into place onto the carrier sheet 14 to adhere along the exposed adhesive area. The easy release sheet on each side of the adhered area of the first plate 12 is carefully removed from the plate and the remaining area of the plate 12 is pressed into place to adhere to the carrier sheet 14. The registration coordinates for a second plate are retrieved, the camera assemblies 18 and 20 and the table 16 are moved into place, the second plate is prepared as described above. This is repeated for all of the remaining plates to be mounted on the carrier sheet 14. It is possible during the plate mounting process that the table 16 may move off from the desired registration coordinates. In this case, the motion controller 32 which retains the y-coordinate for the current plate being mounted, signals to have the table 16 return to the correct y-coordinate location.

The present invention offers advantages in that multiple plates can be mounted onto a carrier sheet 14 with the need for only two camera assemblies 18 and 20. After the carrier sheet 14 is in place on the table 16, and preferably before the plates are mounted on the carrier sheet 14, the layout of the unfolded flat container is drawn onto the carrier sheet 14 which shows, for example, the distorted die cut lines and distorted fold lines of the container. The first camera assembly 18 is positioned at the zero location. The pen 92 in the plotting pen assembly 82 is moved so that the pen 92 contacts the carrier sheet 14. The table 16 and/or the first camera assembly 18 is then moved so that the pen 92 draws the die cut lines, fold lines, and any other relevant markings of the container onto the carrier sheet 14. Marking the carrier sheet 14 assures the printer prior to printing that the plates are positioned properly on the carrier sheet 14 relative to the desired box to be printed, and helps the printer to visualize the printed box.

After all the plates 12 have been mounted to the carrier sheet 14, perimeter edges of each of the plates 12 are sealed into place with an edge sealant to prevent the plate 12 from peeling from the carrier sheet 14 during handling and/or printing. The carrier sheet 14 with the plates 12 is then mounted onto a printing cylinder. The positioning bar 50 can be used to mount the carrier sheet 14 to the cylinder. The sheets are usually held to the cylinder with tension bands or with special clamping devices built into the cylinder.

What is claimed is:

1. An apparatus for mounting a plurality of plates onto a carrier sheet, each plate having a first and a second registration mark thereon, comprising:

a table mounted on a stationary base;

a first camera assembly adjacent the table and moveably attached to a support, said first camera assembly connected to a first video monitor for viewing said first registration marks;

a second camera assembly adjacent the table and moveably attached to said support, said second camera assembly connected to a second video monitor for viewing said second registration marks;

means connected to said first and said second camera assemblies for independently moving each camera assembly relative to said table; and a motion controller connected to said moving means for sending moving signals thereto, said motion controller including means for generating at least two moving signals corresponding to said two registration marks for each plate.

2. An apparatus in accordance with claim 1 wherein said first and second camera assemblies are adapted to move along said support in a first direction, and wherein said second camera assembly includes an offset adjustment assembly comprising a moveable stage adapted to move along a second direction orthogonal to said first direction.

3. An apparatus in accordance with claim 2 wherein said table has means connected thereto for moving said table relative to said stationary base along said second direction.

4. An apparatus in accordance with claim 1 wherein said first and said second camera assemblies each comprise a camera and a preregistration light assembly, and wherein said first camera assembly includes a plotting pen assembly adapted to draw a marking on said carrier sheet.

5. An apparatus in accordance with claim 4 wherein said plotting pen assembly comprises a plotting pen attached to a moveable rod activated by a solenoid plunger.

6. An apparatus in accordance with claim 1 wherein each moving means comprises a linear actuator for receiving said moving signals, and an encoder for measuring the distance each camera assembly or table moves along said first and said second directions.

7. An apparatus in accordance with claim 1 further comprising a first and a second digital display connected to said motion controller for showing, respectively, the position coordinates of said first and said second camera assemblies along said first and second directions.

8. An apparatus in accordance with claim 1 wherein said generating means comprises a software program run by a computer connected to said motion controller.

9. An apparatus in accordance with claim 1 wherein said generating means comprises a preprogrammed memory card contained in said motion controller.

10. A method for mounting a plurality of plates onto a carrier sheet, each plate having a first and a second registration mark thereon, comprising:

(a) placing said carrier sheet on a table mounted on a stationary base;

(b) sending first moving signals from a motion controller to means for moving said table and to means for moving a first camera assembly to first position coordinates corresponding to said first registration mark for a first plate being mounted, said first camera assembly moveably attached to a support adjacent said table and connected to a first video monitor;

(c) sending second moving signals from said motion controller to means for moving a second camera assembly to second position coordinates corresponding to said second registration mark for said first plate being mounted, said second camera assembly moveably attached to said support adjacent said table and connected to a second video monitor;

(d) moving said table and said first and said second camera assemblies in response to said first and said second moving signals so as to locate said first and said second camera assemblies, respectively, at said first and said second position coordinates;

(e) positioning said first plate on said carrier sheet beneath said first and said second camera assemblies so that said first registration mark aligns with a cross-hair image on said first video monitor and said second registration mark aligns with a cross-hair image on said second video monitor; and (f) mounting said first plate onto said carrier sheet after said positioning step.

11. A method in accordance with claim 10 wherein steps (b) through (f) are repeated, respectively, for subsequent plates being mounted on said carrier sheet.

12. A method in accordance with claim 10 wherein the steps of sending said first and said second moving signals from said motion controller is performed by generating said first and said second signals from a software program run by a computer connected to said motion controller.

13. A method in accordance with claim 10 wherein the steps of sending said first and said second moving signals from said motion controller is performed by generating said first and said second signals from a preprogrammed memory card contained in said motion controller.

14. A method in accordance with claim 10 wherein said first and said second camera assemblies are adapted to move along said support in a first direction, wherein said second camera assembly includes a moveable stage adapted to move along a second direction orthogonal to said first direction, and wherein said method further comprises moving said second camera assembly along said second direction.

15. A method in accordance with claim 10 wherein said first camera assembly includes a plotting pen assembly containing a plotting pen, and wherein said method further comprises the step of drawing a marking on said carrier sheet with said plotting pen.

16. A method in accordance with claim 10 wherein each moving means comprises a linear actuator for receiving said moving signals.

* * * * *